US008588660B2

(12) United States Patent
Atzmon

(10) Patent No.: US 8,588,660 B2
(45) Date of Patent: Nov. 19, 2013

(54) STABILIZATION OF INK CONCENTRATION IN A SOLID INK ADD SYSTEM

(75) Inventor: Yavin Atzmon, Ness Ziona Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 287 days.

(21) Appl. No.: 12/670,512

(22) PCT Filed: Jul. 25, 2007

(86) PCT No.: PCT/US2007/016720

§ 371 (c)(1),
(2), (4) Date: Nov. 15, 2010

(87) PCT Pub. No.: WO2009/014520

PCT Pub. Date: Jan. 29, 2009

(65) Prior Publication Data

US 2011/0043557 A1 Feb. 24, 2011

(51) Int. Cl.
*G03G 15/08* (2006.01)

(52) U.S. Cl.
USPC ..... 399/259

(58) Field of Classification Search
USPC ..... 399/27, 53, 258, 259
See application file for complete search history.

(56) References Cited

U.S. PATENT DOCUMENTS

| | | | | |
|---|---|---|---|---|
| 3,409,901 | A | 11/1968 | Dost et al. | |
| 4,974,024 | A * | 11/1990 | Bares et al. | 399/58 |
| 5,202,769 | A * | 4/1993 | Suzuki | 358/300 |
| 5,327,196 | A * | 7/1994 | Kato et al. | 399/58 |
| 5,349,377 | A | 9/1994 | Gilliland et al. | |
| 5,592,298 | A | 1/1997 | Caruso | |
| 6,466,749 | B1 * | 10/2002 | O'Brien | 399/27 |
| 6,731,884 | B2 * | 5/2004 | Kato | 399/27 |
| 6,785,481 | B2 * | 8/2004 | Bray et al. | 399/49 |
| 7,315,704 | B2 * | 1/2008 | Shin et al. | 399/57 |
| 7,676,167 | B2 * | 3/2010 | Yoshioka et al. | 399/53 |
| 7,761,015 | B2 * | 7/2010 | Wong | 399/27 |
| 2002/0141764 | A1 | 10/2002 | Harper et al. | |
| 2004/0085551 | A1 | 5/2004 | Serisky et al. | |

* cited by examiner

*Primary Examiner* — Julian Huffman

(57) ABSTRACT

Apparatus for maintenance of ink concentration stability in a reservoir (12) of a solid ink add printing device (10) over the course of a printing operation, comprises: a look-ahead unit (24) which looks at incoming printing instruction data (22) to determine pending ink usage, and a dynamic feed mechanism control unit (18) to dynamically control the feeding mechanism to modify feeding of the ink particles based on the determined pending ink usage.

13 Claims, 4 Drawing Sheets

STABILIZATION OF INK CONCENTRATION IN A SOLID INK ADD SYSTEM

FIELD AND BACKGROUND OF THE INVENTION

The present invention relates to the stabilization of ink concentration in a solid ink add system and, more particularly, but not exclusively to the stabilization of ink concentration in the ink reservoir of a printer, wherein the reservoir is fed from a can of ink powder or from a suspension of ink powder.

The ink feed system in which solid ink is added to a reservoir of ink carrier or solvent is known as the solid add system. Using the solid add system, the idea is to control the viscosity in the reservoir to ensure stable color. In general printers are provided with a pre-designed ink feed cycle. During the cycle a solid add valve which is located between the ink can and the reservoir is open for a certain amount of time. Air pressure within the printer ensures that powder is fed from the can into the reservoir when the valve is open.

The extent to which the valve is open, the duty cycle of the valve, is a design feature of the particular printer. In designing the duty cycle an assumption is made that the current printing operation requires high levels of ink, that is high coverage. That is to say the duty cycle is chosen based on a worst case scenario as regards ink demand. The result is that in many cases the solid concentration in the ink becomes too high. Other assumptions are made regarding air pressure, amount of solid in the can etc.

In the typical solid ink add system, the amount of solid that is added over the duty cycle can vary strongly, depending on such diverse factors as the system air pressure, the coverage intensity required by the current print operation and paste viscosity in the can. Paste viscosity depends on the solid ink can state, that is whether it is full or empty, and even on whether it was shaken prior to installation. Viscosity in the reservoir depends on the amount of solid added but also on the sum total of Non Volatile Solid (NVS) concentration in the reservoir. The system is designated to support high coverage separations, that is printings of up to 100% coverage. Thus, in cases of low coverage and/or unexpected settings of the other parameters referred to above, there is an overshoot in the solid concentration in the tank.

While existing printers are able to measure the viscosity in the reservoir and apply or not apply ink feed, the duty cycle itself is fixed, often leading to instability in the viscosity within the reservoir.

Some printers have the capability to notify a user when the amount of powder in the ink can is too small to achieve the design viscosity, so that the user can change the can.

SUMMARY OF THE INVENTION

According to one aspect of the present invention there is provided apparatus for maintenance of ink concentration stability in a reservoir of a printing device over the course of a printing operation, the reservoir being fed by solid ink particles via a feeding mechanism, the apparatus comprising:

a look-ahead unit configured for looking at incoming printing instruction data to determine pending ink usage, and a dynamic feed mechanism control unit, associated with the look ahead unit, to dynamically control the feeding mechanism to modify feeding of the ink particles based on the determined pending ink usage.

According to a second aspect of the present invention there is provided a method of stabilizing ink concentration in solid add printers during printing of variable coverage spreads, the method comprising:

receiving printing instructions for an incoming spread;

analyzing the printing instructions to determine a coverage level of the incoming spread; and when printing the spread, dynamically modifying a feed rate of solid to an ink reservoir in accordance with the determined coverage level.

Unless otherwise defined, all technical and scientific terms used herein have the same meaning as commonly understood by one of ordinary, skill in the art to which this invention belongs. The materials, methods, and examples provided herein are illustrative only and not intended to be limiting.

Implementation of the method and system of the present invention involves performing or completing certain selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions. Such steps include analyzing the print instructions and altering the ink feed valve duty cycle accordingly.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
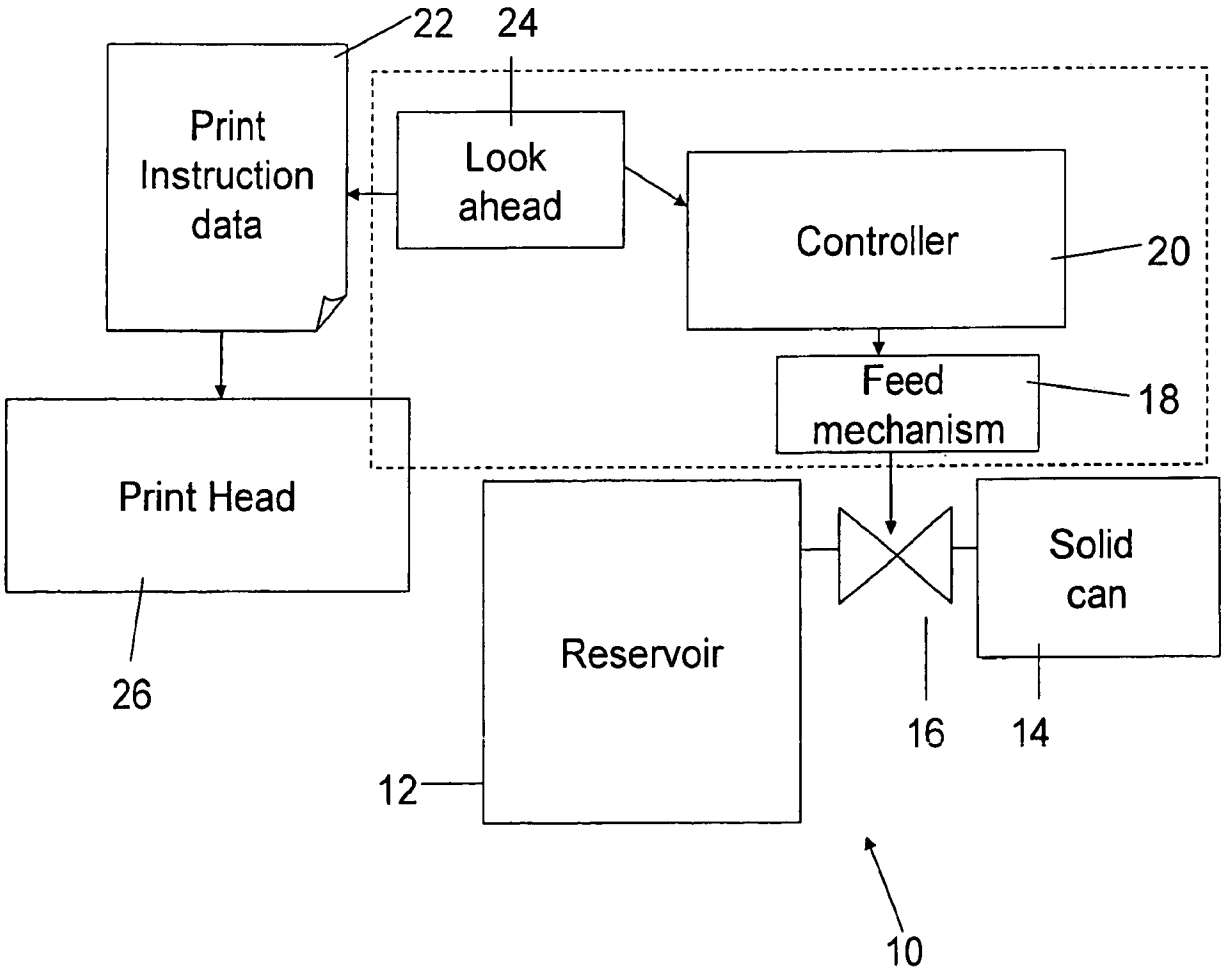
FIG. 1 is a simplified diagram showing a solid ink add mechanism according to a first embodiment of the present invention.

The present embodiments comprise an apparatus and a method for stabilizing the ink concentration levels in a printer during printing of spreads with widely varying coverage levels. Stabilization is achieved by analyzing the incoming print instructions prior to printing and estimating ink usage and coverage in the coming print operation. The rate of feed of solid to the ink reservoir may then be modified specifically for the coming operation, based on the estimated ink usage.

Typically the printer has a standard feed mode which is optimized for high coverage printing. The standard mode is preferably retained as long as high coverage is detected. However the feed mode is modified if low coverage levels are detected in the incoming operation. The modified feed mode may be a uniform lower rate of feed or it may be a dynamic rate set according to the determined ink requirement and also according to other printer parameters such as air pressure, or whether the ink powder container (ink can) is full or empty.

The principles and operation of an apparatus and method according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Reference is now made to FIG. 1, which illustrates apparatus 10 which is part of a printer. The apparatus is for maintenance of ink concentration stability in reservoir 12 of the printer over the course of a printing operation. Reservoir 12 contains a carrier liquid and is fed by solid ink particles from can 14. Can 14 feeds the reservoir via valve 16 which is controlled by feed mechanism 18. A dynamic feed mechanism control unit 20, hereinafter referred to as a controller, operates the feed mechanism.

The controller is connected to a look-ahead unit 24, and the look ahead unit looks at incoming printing instruction data 22 to determine pending ink usage. That is to say the look ahead unit is a device that looks at the print instruction data to obtain a measure of how much ink is required in the coming print operation, as will be explained in greater detail below.

The dynamic feed mechanism control unit, controls the feeding mechanism to modify feeding of the solid ink particles based on the determined ink usage for the coming print operation. As will be explained below, control is dynamic in that ink feed settings are decided independently for each separate printing operation, which means for the printing of each separate spread of a print job. Furthermore the control may respond to changes in parameters of the printer, such as air pressure or the full/empty state of the can 14. Typically the incoming printing instruction data is not the conventional print file produced by a typical printer driver but rather is data in a format suitable for direct operation of said printing device. That is to say it is the derivative of the print file that actually operates the print head.

In one embodiment the printing device is a laser printer, and print head 26 comprises a laser. In such a case the incoming printing instruction data may comprise on-off instructions for the laser, and the look-ahead unit is able to determine aggregated laser on time as a measure of pending ink usage. That is to say the instructions tell the laser when to be on over the course of the spread, and the look ahead unit is able to calculate the total on-time. The total laser on-time is proportional to the amount of ink used.

In one embodiment the controller has a preset threshold ink usage level. The feed mechanism then operates in one of two modes, depending on which side of the threshold the ink usage measure lies. Typically the print feed is optimized for heavy ink usage, so if the measure is found to be above the threshold then regular ink feed is used. The regular ink feed is typically substantially constant and is also high. The second feeding mode, used when the threshold is not reached is of course lower, and may be variable.

Figure 2:
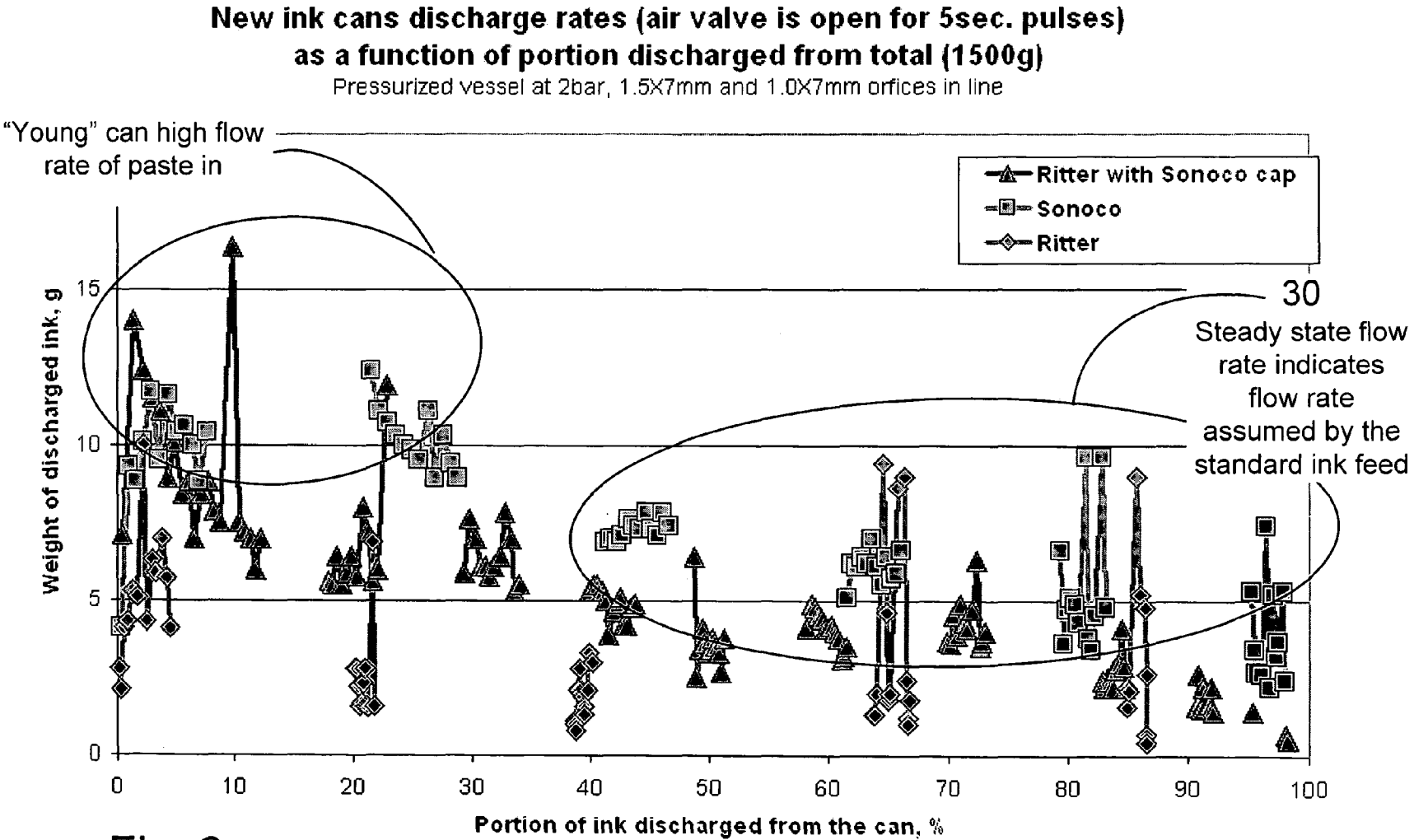
FIG. 2 is a simplified diagram showing how ink discharge levels vary over the life of the can of FIG. 1.

The second feeding mode may, as mentioned above, use one or more machine state parameters, in order to set a feeding rate within the variation range. As mentioned, the state of can 14, in the sense of how full it is, can be used. Reference is made in the connection of can state to FIG. 2, which is a scatter graph of weight of ink particle discharge against the cumulative proportion of the ink can in percent that has been discharged. The results are shown for five second pulses. Triangles, squares and diamonds indicate actual points achieved with different types of cans. It is clear from the scatter graph that the rate of flow of ink particles naturally falls off as a greater percentage portion of the ink is discharged, but it is also clear that there is a large variation even for the same kind of can under the same conditions. Steady state line 30 indicates the flow rate assumed by the standard ink feed, but it is clear that the line is only an approximation. Another parameter that may be used to vary the feed is the air pressure within the can 14.

Typically the ink feed is governed by the amount of time during which valve 16 is held open. In the first or regular mode the valve is opened for regular pulses of even duration separated by small gaps. In the second mode, either the pulse may be shorter or the gap in between may be longer or both. Typically the overall ink cycle is fixed and the second mode is achieved by adding wait periods before opening the valve over the cycle.

Figure 3:
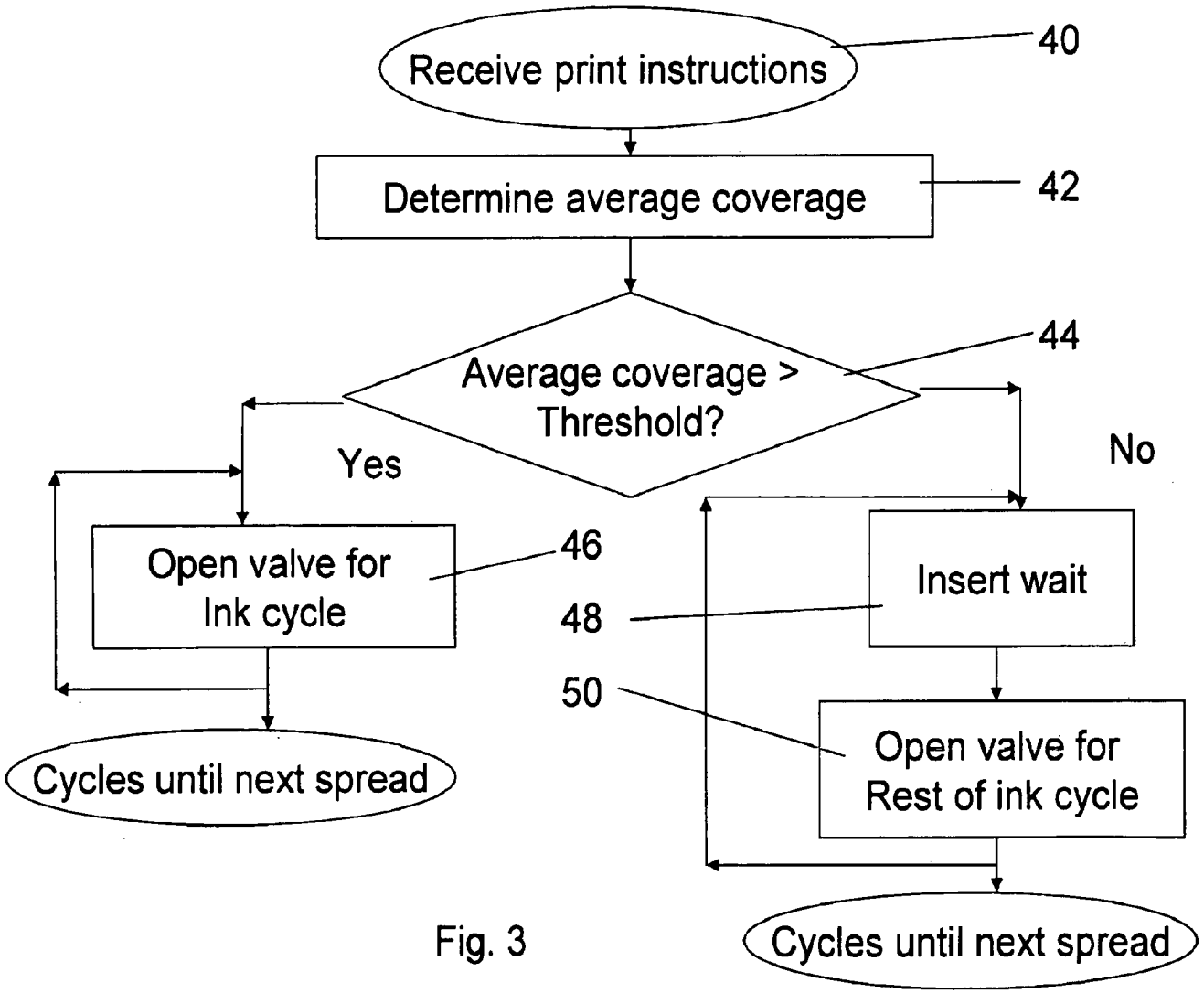
FIG. 3 is a simplified flow chart of a process for adding solid ink to a reservoir according to an alternative embodiment of the present invention.

Reference is now made to FIG. 3, which illustrates a method of stabilizing ink concentration in solid add printers during printing of variable coverage spreads. The method comprises receiving printing instructions for an incoming spread, analyzing the printing instructions to determine the coverage level of ink defined for the incoming spread; and then when printing the spread, dynamically modifying the feed rate of solid to an ink reservoir in accordance with the determined coverage level.

In greater detail incoming print instructions arrive in stage 40, and contain the amount of time that the laser is on over the coming spread. The average coverage level, or ink usage, is determined in stage 42, and then in stage 44 is compared to a threshold. If the coverage exceeds the threshold then the solid feed valve 16 is opened to the designed extent over the ink feed cycle in stage 46. That is to say ink feed involves feed cycles. For each cycle in which it is desired to feed ink, the valve is open for a certain proportion of the cycle time. The designed extent is that proportion selected for the specific machine in order to allow effective powder feed for the highest coverage spreads, this is the standard duty cycle referred to above. The same ink feed mode is used for the remaining cycles of the spread.

As explained not all spreads require such high coverage and therefore the viscosity of the ink in the reservoir may rise if not otherwise treated. Returning to stage 44, if the average coverage of the spread does not exceed the threshold then stage 48 is entered in, which a wait period is inserted in to the ink feed cycle so that the valve is open for less than the maximum extent of the ink feed cycle in stage 50. The duty cycle, may be reduced for example to 50%.

In one embodiment the threshold is calculated from the powder add rate in regular feed mode divided by the dot gain of the print medium in use multiplied by the ink density on the page in grams per square centimeter. Thus different thresholds may be used for different print media. Alternatively a single default threshold may be used, as desired.

In general the duty cycle of the solid add system is intended to push powder into the reservoir until the solid level in the tank, measured by the viscosity or density or other correlative physical property, reaches a set point.

If the density does not reach the set point within a certain amount of time then the system requests can replacement.

Figure 4:
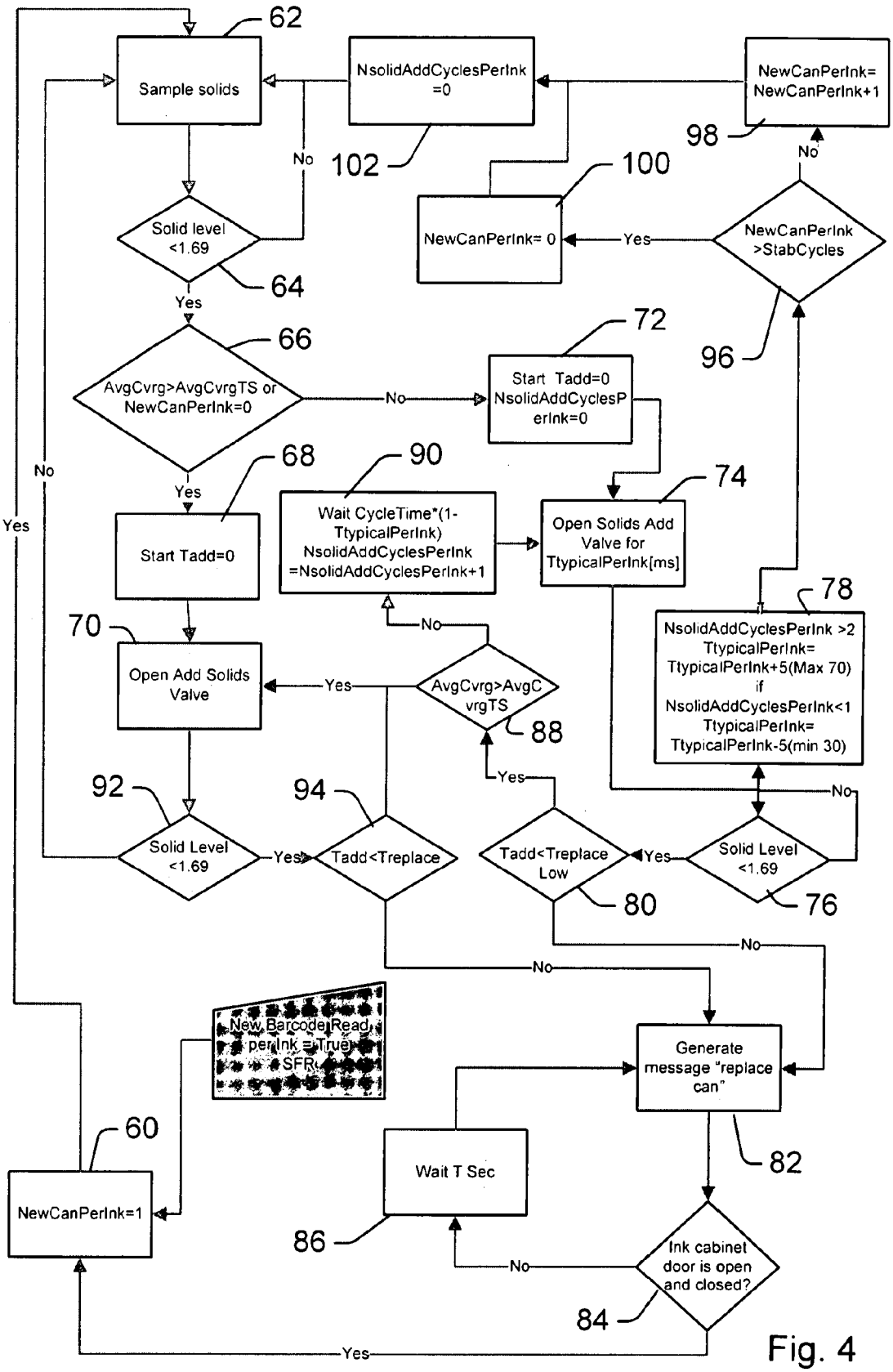
FIG. 4 is a simplified flow chart illustrating the lifecycle of an ink can according to an embodiment of the present invention.

Reference is now made to FIG. 4, which is a simplified flow chart illustrating the life cycle of a solid ink can in a printer operative according to an embodiment of the present invention. Taking stage 60 as the starting point a new can is inserted into the printer. The solids in the can are sampled in stage 62 to determine whether ink feed is required at all. In stage 64 the solid level in the can is thresholded. Then, in stage 66, if ink feed is required, the average coverage, of the incoming spread is determined from the print instructions, as explained above and is compared against threshold AvgCvrgTS. If the average coverage is greater than the threshold then the ink add mode, indicated by stages 68 and 70 is entered and the solid add valve is opened in the standard way.

If the average coverage is less than the threshold then in box 72 a variable called NsolidAddParticlesPerink is set to zero. The variable NsolidAddParticles is then used as a counter for the number of cycles needed to get the ink concentration up to the required level. In box 74 the valve 16 is opened for a period of time TtypicalPerink. That is to say the time the valve is open is now controlled and not standard. In box 76 the level of solid in the reservoir is tested.

If the level of solid following the test is too high, then the variables are adjusted in stage 78. Stage 78 determines the momentary gain of solid add according to the number of required cycles. If the solid add powder is low, sat due to low air pressure, or high viscosity in the can then at stage 78 it is possible to modify the air pressure open time duty cycle in order to compensate for the measured deficiencies. Stages 96-102 comprise a procedure for identifying when can replacement is needed.

On the other hand, if the solid level is low then the system branches in box 80 check the age of the can and if necessary enters a procedure for replacing the can, boxes 82, 84 and 86. If however the age of the can does not necessitate replacement then box 88 is entered where the next spread is tested for average coverage. If the threshold is exceeded then regular ink add mode is entered again at box 70. If the threshold is not exceeded, then variable ink add mode is added via box 90 where a wait cycle is set, and NSolidAddCyclesPerInk is incremented.

Stage 80 determines whether the coverage has or has not changed over the course of the adding activity. Stages 80, 94 and 66 provide for prevention of overshoot in the non-volatile solid (NVS) concentration, when a new can is installed. Stages 80, 94 and 66 provide for the prevention of undershoot in NVS concentration when the coverage level is high.

In addition there is provided an option to identify inefficiency of the solid add system by comparing with the theoretical coverage, which includes the dot gain and actual consumption. There is also provided an option to identify overconsumption of the ink due to bad initial transfer.

Both of these options are managed by comparing the actual consumption of the ink with digital image prediction.

Actual consumption=(Can weight[gr])×(% of solids)

Calculated consumption=(coverage per ink area per ink[$mm^2$])×(dot mass area gr/$mm^2$)×(% of Dot Gain).

If the on going ratio between actual and calculated consumption exceeds a predetermined threshold percentage then it may be assumed that there is a problem in the solid add system. A suitable threshold may be ten percent.

The age of the can is tested after regular add mode in boxes 92 and 94 which are the same as boxes 76 and 80.

Use of the present embodiments is thus based on a real time digital coverage calculation that enables the printer, or the press, to control the solid add gain and by that avoid overshoot or undershoot of the solid concentration in the press ink reservoirs or tanks. The embodiments thereby reduce the ink concentration instability in the tank and improve the color stability on the printout as well as stabilizing the input parameters of the development process.

It is expected that during the life of this patent many relevant devices and systems will be developed, and the scope of the terms herein is intended to include all such new technologies a priori.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents, and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. Apparatus for maintenance of ink concentration stability in a reservoir of a printing device over the course of a printing operation, the reservoir being fed by via a feeding mechanism, the apparatus comprising:

a look-ahead unit configured for looking at incoming printing instruction data to determine pending ink usage, and a dynamic feed mechanism control unit, associated with said look ahead unit, to dynamically control said feeding mechanism to modify feeding of said ink particles based on said determined pending ink usage;

wherein the dynamic feed mechanism control unit is configured to adjust a length of time the feeding mechanism adds solid ink particles to the reservoir in response to a level of solid ink particles in the reservoir becoming greater than or equal to a set-point level;

wherein the length of time is adjusted based on what a count of a number of solid ink particle add cycles is whenever the level of the solid ink particles in the reservoir becomes greater than or equal to the set-point level; and wherein the count of the number of solid ink particle add cycles is incremented only when the level of the solid ink particles in the reservoir is less than the set-point level and the determined pending ink usaqe does not exceed a threshold level.

2. Apparatus according to claim 1, wherein the printing device is a laser printer having a laser, and the incoming printing instruction data comprise on-off instructions for the laser.

3. Apparatus according to claim 2, wherein the look-ahead unit is configured to determine aggregated laser on time as a measure of pending ink usage.

4. Apparatus according to claim 1, wherein said dynamic feed mechanism control unit is configured to add the solid ink particles to the reservoir at a rate that is independent of the number of solid ink particle add cycles when the pending ink usage exceeds the threshold level and the level of the solid ink particles in the reservoir is less than the set-point level.

5. Apparatus according to claim 1, wherein said incoming printing instruction data comprises data in a format suitable for direct operation of said printing device.

6. Apparatus according to claim 1, wherein the length of time is decreased in response to the count of the number of solid ink particle add cycles being less than a certain first number when the level of the solid ink particles in the reservoir becomes greater than or equal to the set-point level and the length of time is increased in response to the count of the number of solid ink particle add cycles being greater than a certain second number when the level of the solid ink particles in the reservoir becomes greater than or equal to the set-point level, wherein the certain second number is greater than the certain first number.

7. Apparatus according to claim 1, wherein the apparatus is configured to test the level of solid ink particles in the reservoir.

8. Apparatus according to claim 1, wherein the apparatus is configured to request replacement of a container that supplies the solid ink particles to the reservoir if the level of the solid ink particles in the reservoir does not reach the set-point level within a certain amount of time.

9. A method of stabilizing ink concentration in solid add printers during printing of variable coverage spreads, the method comprising:

receiving printing instructions for an incoming spread;

analyzing said printing instructions to determine a coverage level of said incoming spread;

when printing said spread, dynamically modifying a feed rate of solid to an ink reservoir in accordance with the determined coverage level; and adjusting a length of time solid ink particles are added to a reservoir in response to a level of solid ink particles in the reservoir becoming greater than or equal to a set-point level;

wherein the length of time is adjusted based on what a count of a number of solid ink particle add cycles is whenever the level of the solid ink particles in the reservoir becomes greater than or equal to the set-point level; and wherein the count is incremented only when the level of the solid ink particles in the reservoir is less than the set-point level and the determined coverage level does not exceed a threshold level.

10. The method of claim 9, further comprising when the determined coverage level exceeds the threshold level and the level of the solid ink particles in the reservoir is less than the set-point level, adding the solid ink particles to the reservoir at a rate that is independent of the number of solid ink particle add cycles.

11. The method of claim 9, wherein the length of time is decreased in response to the count of the number of solid ink particle add cycles being less than a certain first number when the level of the solid ink particles in the reservoir becomes greater than or equal to the set-point level and the length of time is increased in response to the count of the number of solid ink particle add cycles being greater than a certain second number when the level of the solid ink particles in the reservoir becomes greater than or equal to the set-point level, wherein the certain second number is greater than the certain first number.

12. The method of claim 9, further comprising testing the level of the solid ink particles in the reservoir before and after adjusting the length of time.

13. The method of claim 9, further comprising requesting replacement of a container that supplies the solid ink particles to the ink reservoir if the level of the solid ink particles in the ink reservoir does not reach the set-point level within a certain amount of time.

* * * * *

UNITED STATES PATENT AND TRADEMARK OFFICE

CERTIFICATE OF CORRECTION

PATENT NO. : 8,588,660 B2
APPLICATION NO. : 12/670512
DATED : November 19, 2013
INVENTOR(S) : Yavin Atzmon It is certified that error appears in the above-identified patent and that said Letters Patent is hereby corrected as shown below:

In the Claims

In column 6, line 48, in Claim 1, delete “by via” and insert -- via --, therefor.

In column 7, line 2, in Claim 1, delete “usaqe” and insert -- usage --, therefor.

Signed and Sealed this
Fifteenth Day of April, 2014

Michelle K. Lee

Michelle K. Lee
*Deputy Director of the United States Patent and Trademark Office*